United States Patent [19]

Brundin

[11] 3,932,759

[45] Jan. 13, 1976

[54] X-RAY DIAGNOSTIC INSTALLATION PROVIDING FOR THE FREE AND PROGRAMMED SETTING OF THE X-RAY EXPOSURE DATA

[75] Inventor: Bengt Brundin, Sollentuna, Sweden

[73] Assignee: Siemens Aktiengesellschaft, Erlangen, Germany

[22] Filed: Mar. 1, 1974

[21] Appl. No.: 447,247

[30] Foreign Application Priority Data

Mar. 7, 1973 Germany ..... 2311211

[52] U.S. Cl. ..... 250/416; 250/410

[51] Int. Cl.[2] ..... H05G 1/30

[58] Field of Search ..... 250/408, 409, 410, 416

[56] References Cited

UNITED STATES PATENTS

| | | | |
|---|---|---|---|
| 2,931,908 | 4/1960 | Hardenburg | 250/416 |
| 3,163,757 | 12/1964 | Fransen | 250/410 |
| 3,459,941 | 8/1969 | Redzinsky et al. | 250/416 |
| 3,492,483 | 1/1970 | Brandelik et al. | 250/416 |
| 3,746,862 | 7/1973 | Lombardo et al. | 250/409 |

*Primary Examiner*—James W. Lawrence
*Assistant Examiner*—D. C. Nelms
*Attorney, Agent, or Firm*—Haseltine, Lake & Waters

[57] ABSTRACT

An X-ray diagnostic installation including means for the unrestricted and for the programmed, in conformance with particular organs of a patient, adjustment or setting of the exposure data. The installation includes data input storage associated with the means for the organ-programmed data setting in which, for each operating key, there is contained an input or storage cell for the particular desired exposure data program, and in which upon depression of the respective key and through actuation of a programming switch there is storable the currently set exposure data at the panel for free or unrestricted data setting, and which are operatively connected with the setting means for the transmission of their information to the setting means for the X-ray generator upon depression of the associated operating key and for an unactuated programming switch.

5 Claims, 2 Drawing Figures

X-RAY DIAGNOSTIC INSTALLATION PROVIDING FOR THE FREE AND PROGRAMMED SETTING OF THE X-RAY EXPOSURE DATA

FIELD OF THE INVENTION

The present invention relates to an X-ray diagnostic installation including means for the unrestricted and for the, in conformance with the particular organ of a patient, adjustment or setting of the exposure data.

DISCUSSION OF THE PRIOR ART

An X-ray diagnostic installation of this type has become known through a publication in the Journal "Electromedica" 1971, pages 83 through 86. Each examining instrument has an instrument board or panel associated therewith which includes operating keys for the programming setting of exposure data, related to the organ of a patient. The number of instrument panels in this X-ray diagnostic installation corresponds with the number of X-ray examining instruments which are fed by a common or central X-ray generator. A central panel is consequently selectable from the instrument panels for effecting the unhindered or free setting of the exposure data. The programming is carried out in the electronic portion through the aid of transmission conduits which are switched between dividers corresponding to a particular desired program. In order to change an exposure program dependent upon one of the operating keys of an instrument panel, it is necessary to also change the transmission conduit connections within the electronic portion. Accordingly, programming cannot be carried out by the physician alone, but for the programming of new exposure data it is necessary that the physician obtains the services of a technician who will then implement the required switching modifications. Furthermore, even for minor and for extensive changes in the organ program, there is need for a special expenditure. For this purpose, presently known X-ray diagnostic installations require correction knobs which serve, for example, for correcting the degree of exposure darkening.

SUMMARY OF THE INVENTION

Accordingly, it is an object of the present invention to provide an X-ray diagnostic installation of the type mentioned, in which the programming is so simplified in comparison with the state of the technology, as to be rendered capable of being unassistedly effected by the physician.

The object of the invention is inventively carried out in that there is provided a data input storage associated with the means for the data setting programmed pursuant to the organs of a patient, in which, for each operating key, there is contained an input or storage cell for the particular desired exposure data program, and in which upon depression of the respective key and through actuation of a programming switch, there is storable the currently set exposure data at the panel for free or restricted data setting, and which are operatively connected with the setting means for the transmission of stored information to the setting means for the X-ray generator upon depression of the associated operating key and for an unactuated programming switch. Through the invention there thus is rendered possible a programming in a simple manner by means of adjustment or setting of the desired exposure data for a predetermined operating key, and upon the actuation of a programming switch at a depressed operating key. The physician consequently may alone assume, without the aid of a technician, the programming sequence. Changes and corrections of a singly set program may, in a similar manner, be simply carried out by only the physician.

A further feature of the invention lies in that, for the setting of the X-ray generator, there is employed an adjustment or setting storage means which is controllable from the operating elements for unrestricted data setting and in response to the depression of an operating key of the program storage. The setting storage means may also afford, upon the depression of an operating key, indication of the exposure data associated with that particular operating key on the panel for effecting unrestricted data setting or adjustment.

The program switch may be constituted of a key switch, thereby providing assurance that an unintentional change of a previously singly selected program cannot be effected.

BRIEF DESCRIPTION OF THE DRAWINGS

Further details of the invention may be ascertained from the following description of an exemplary embodiment thereof, taken in conjuction with the accompanying drawings, in which.

DETAILED DESCRIPTION

Figure 1:
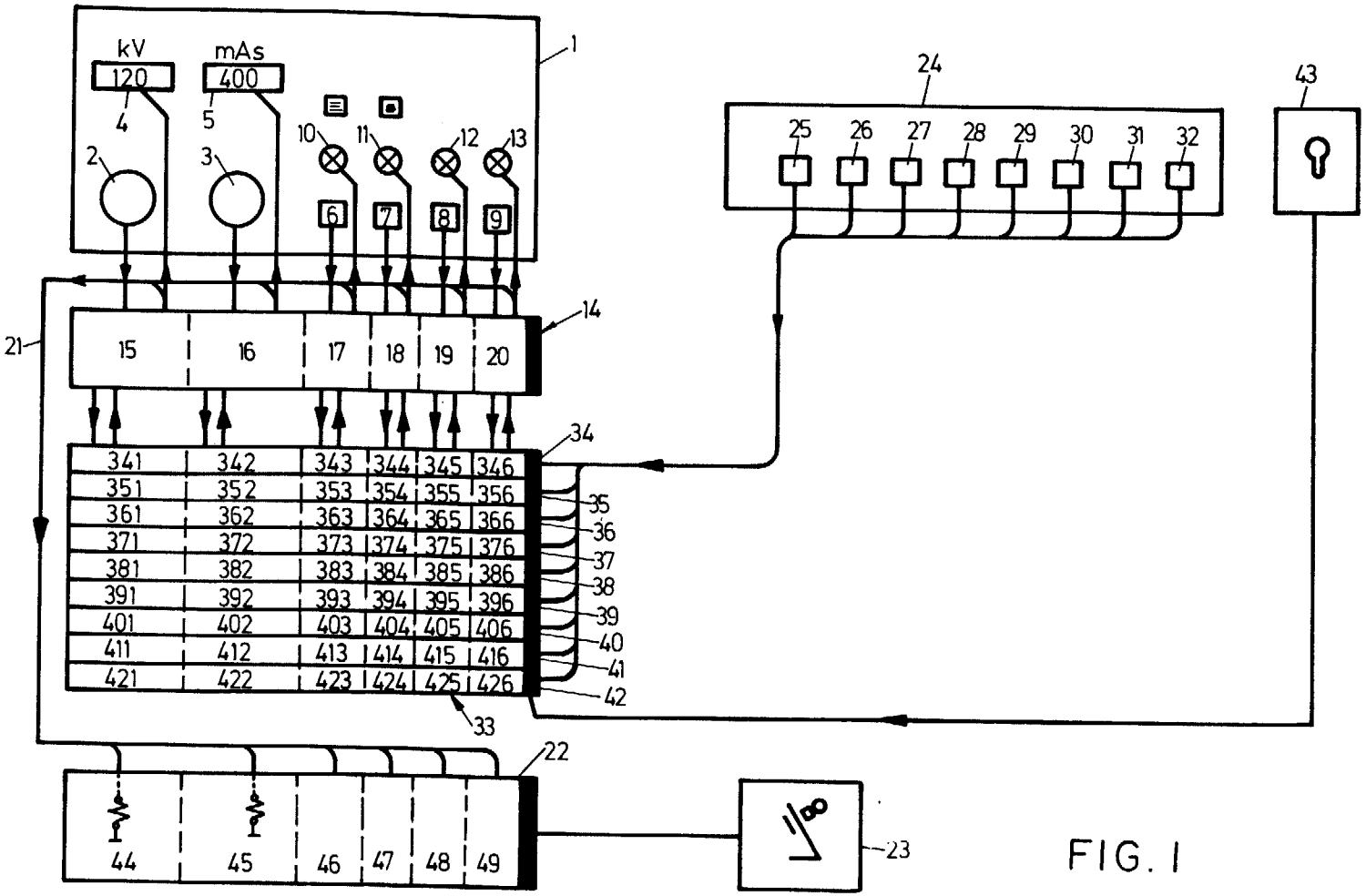
FIG. 1 illustrates a circuit diagram of an X-ray diagnostic installation in accordance with the present invention.

Referring now to FIG. 1, there is illustrated a central control panel 1, on which there are provided two knobs 2 and 3 for, respectively, the setting of the X-ray tube voltage and the mAs-product. The X-ray tube voltage is indicated in an indicator window 5 and the mAs-product in an indicator window 5. Furthermore, the central panel 1 includes keys or push buttons 6 through 9 for the setting of additional exposure data, for example, for the selection of the focus of an X-ray tube, and the dominants of the field of measurement of the beam measuring chamber of an automatic illuminating device. The visual indication of the particular depressed key is obtained by means of lights 10 through 13.

The central panel 1 has a setting storage 14 associated therewith, which includes a storage cell for each of the setting organs of the central panel 1. These storage cells are designated in the drawing by reference numerals 15 through 20. The storage cells 15 through 20 also effect the control of the indicating arrangements 4, 5 and 10 through 13. Furthermore, the storage cells 15 through 20 through the intermediary of a cable 21 adjust operation of the X-ray generator 22. The X-ray generator 22 serves for the supply and control of a schematically illustrated X-ray examining apparatus 23.

The X-ray examining apparatus 23 has an instrument panel 24 associated therewith which, in the illustrated exemplary embodiment, includes operating keys or push buttons 25 through 32, which facilitate the setting of the exposure data for the X-ray examining apparatus 23 in programmed in conformance with the organs of a patient manner. Upon depression of one of the operating keys 25 through 32, a completely determinate exposure data combination is set thereby.

A program storage 33 is associated with the instrument panel 24 and which includes a storage cell 34 through 42 for respectively each of the operating keys 25 through 32. Each of the storage cells 34 through 42 includes six single storages in correspondence with the setting elements 2, 3 and 6 through 9 on the central panel 1. The single storages are designated in the drawings by 341 through 346, 351 through 356, and so forth. The program storage 33 has a key switch 43 associated therewith for the programming sequence.

If operation is effected with the central panel 1, in effect meaning that none of the operating keys 25 through 32 are depressed, then the exposure data which have been set by means of the setting or adjusting elements 2, 3 and 6 through 9, are transmitted into the storage cells 15 through 20 of the setting storage 14. The supply cells 15 through 20, through the intermediary of cable 21, effect the setting of the X-ray generator 22 in conformance with the exposure data which has been preselected on the central panel 1. The X-ray generator 22 includes a number of adjusting elements 44 through 49 corresponding in number with exposure data which is to be set and which are influenced by the storage cells 15 through 20.

For programming of the exposure data, one of the operating keys 25 through 32 is depressed, and the key switch 43 actuated. If, for example, the operating key 25 is depressed, then the exposure data set at the central panel 1 are transmitted to the storage cell 34 through the setting storage 14. The programming of the exposure data for the operating keys 26 through 32 is carried out in a similar manner. After completion of the programming, the key switch 43 is again returned into its inoperative or at-rest position.

If the control of the X-ray generator 22 is to be effected from the instrument panel 24, one of the operating keys 25 through 32 is depressed pursuant to a particular desired exposure condition or, respectively, the organ, without actuating the key switch 43. In that manner, the content of the associated storage cells 34 through 42 is transmitted to the setting storage 14 so that the X-ray generator 22 is set or adjusted in accordance with the preprogrammed exposure data. The storage cells of the setting storage 14 effect a control of the indicating installations 4, 5 and 10 through 13, so as to afford indication of the preprogrammed exposure data at the central panel 1. Minute corrections of the exposure data may be carried out at the central panel 1 without the need for changing the storage program, if the key switch 43 is not actuated.

In order to vary or change a program, as previously described, the respective operating keys 25 through 32 are depressed, and the key switch 43 actuated. The change is then effected through actuation of the setting elements 2, 3 and 6 through 9.

Within the scope of the invention there may also be contemplated the provision of more than one instrument panel. Each key or push button of the instrument panel may have a program storage cell associated therewith. Each cell may also be utilized for a plurality of boards when the identical programming is desired. The switching-in of the program storage at the setting storage 14 follows through the application of more than one instrument panel corresponding to the selection of the instrument panels, in effect, in conformance with the particular instrument panel which is being operated. For this purpose, a special key or push button may be provided for each instrument panel.

Also within the scope of the invention, the number of setting elements on the central panel 1 is without any particular significance. In lieu of six setting elements there may also be provided fewer or more setting elements as required.

The above described exemplary embodiment allows the physician by himself to carry out a programming sequence. For this purpose, he need only actuate the key switch 43 and the respective operating keys 25 through 32, and then set the desired exposure data on the central panel 1. In the illustrated embodiment, there further follows at the central panel 1 indication of the adjusted exposure data dependent upon the depression of one of the operating keys 25 through 32. Changes in the set exposure data responsive to depression of an operating key without changing the program is enabled at the central panel 1 through the intermediary of setting elements which are located thereon. In that instance the content of the storage 14 is changed, while the content of storage 33 remains unchanged, inasmuch as the key switch 43 has not been actuated.

Figure 2:
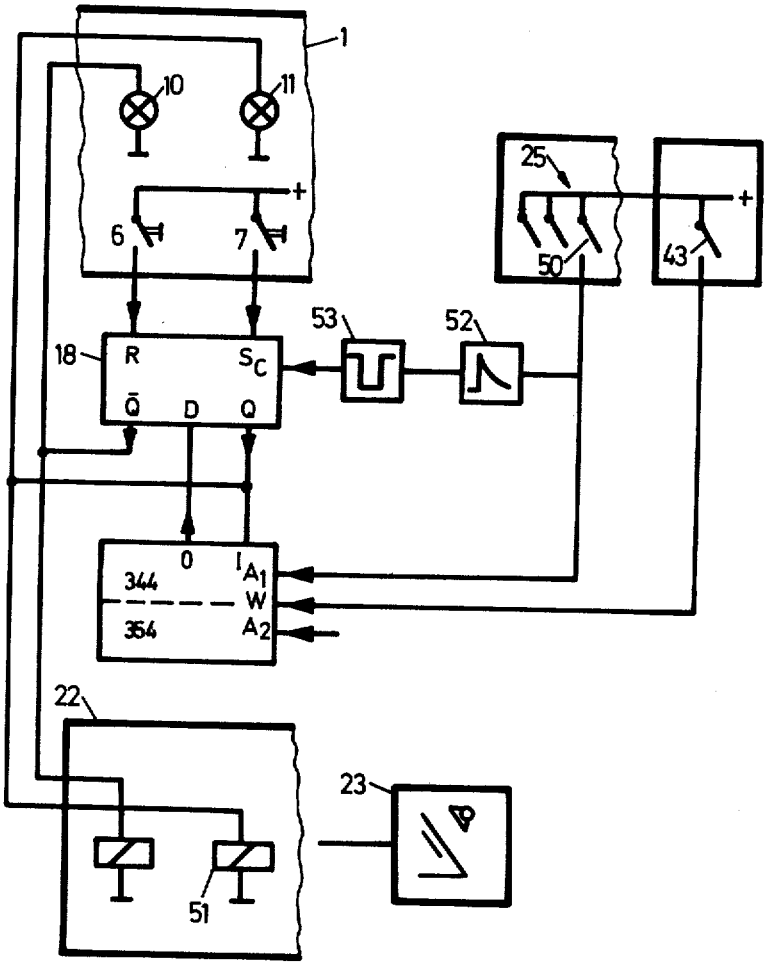
FIG. 2 illustrates a detailed circuit diagram of a means for focal setting of the installation of FIG. 1.

As shown in FIG. 2, the setting and storage sequences are explained as follows:

In FIG. 2 the keys 6 and 7, as well as the associated lights 10 and 11 are schematically indicated on the central panel 1. The keys 6 and 7 serve for the selection of the focus of the X-ray tube of the X-ray examining apparatus 23. This X-ray tube possesses two different focuses. It is assumed that the focus associated with the key 7 is fed into the single storage 344, in effect, the key 25 should be correspondingly programmed. The key 25, pursuant to FIG. 2, has a plurality of contacts, of which the contact 50 effects the control of the single storage 344.

If the key 7 is depressed then a 1-signal is supplied to the set-input S of the single storage 18. The 1-signal is stored in the setting storage 18, and at the output Q there is provided an adjusting signal. The 1-signal at the output Q switches in the light 11 and controls the relay 51 which, in a known manner, selects the focus associated with the key 7.

At the I-input of the program storage 344 there is also formed a 1-signal. When the operating key 25 is depressed, and consequently contact 50 closed, an 1-signal is transmitted to the address input A1. The infeed of the 1-signal at the input I in the single storage 344 first follows, when a 1-signal is present at the W-input of the single storage 344, in effect meaning, that the programming switch 43, which is similarly schematically illustrated in FIG. 2, is closed. Only then is the 1-signal recorded in the single storage 344. If the infeed of the 1-signal is effected in the single storage 344, and were the operating key 25 to be actuated, then this 1-signal lies at the output 0 of the single storage 344. Upon closing of the contact 50, a pulse is transmitted to the clock-input C of the setting storage 18 through a differentiating element 52 and a level detector 53, which causes that the same signal lies at the Q-output of the setting storage 18, as well as at the D-input. This signifies that the 1-signal is transmitted from the single storage 344 to the central panel 1 and to the generator 22. The signal also illuminates light 11, and relay 51 switches-in the respective focus of the X-ray tube. When the focus associated with the key 7 is programmed into the single storage 344, it is thereby automatically selected upon actuation of the operating key 25, without need for depression of the key 7.

If the key 6 is actuated during depression of operating key 25, then a return setting signal is transmitted to the resetinput R of the single storage 18, which converts the 1-signal at the output Q into an 0-signal. It is also possible to select for a depressed operating key 25, through actuation of key 6, another focus then that which has been programmed by means of key 7. The focus programmed in the single storage 344 does, however, remain stored so that, after opening of the key 7, the focus associated with key 7 is again automatically selected.

In FIG. 2, for purposes of clarity of viewing, only one-half of the single storage 354 is illustrated, having the operating key 26 associated therewith. The programming of the operating key 26 is obtained in the same manner as the programming of the operating key 25. Concurrently-with the introduction of the 1-signals to the input I of the setting storage 344, this signal is also transmitted to the corresponding input of the single storage 354.

In FIG. 4 there is shown only the storage of the focus of the X-ray tube associated with key 7, and the programming of the operating key 25. In a similar manner a single storage is associated with the key 6, and the programming of the focus associated with key 6 is correspondingly effected. Also the storage of the other exposure data and the corresponding programming of the operating keys follows in the same manner.

While there has been shown what is considered to be the preferred embodiment of the invention, it will be obvious that modifications may be made which come within the scope of the disclosure of the specification.

What is claimed is:

1. An X-ray diagnostic installation comprising means for the unrestricted setting and for setting of exposure data which are programmed dependent upon predetermined organs of a patient; an instrument panel; operating key means mounted on said instrument panel; data storage means connected to said data setting means;

storage cell means in said storage means each having a particular exposure data program stored therein and associated with a respective one of said operating key means; and a programming switch connected to said instrument panel, said storage cell means adapted to store the currently set exposure data for an unrestricted data setting responsive to depression of the operating key associated therewith and the actuation of said program switch, and with said storage cells being connected with said setting means for the transmission of their stored contents to said setting means for an X-ray generator upon depression of the therewith associated operating key and with the programming switch being in a non-actuated position.

2. An installation as claimed in claim 1, said setting means being utilized for adjustment of said X-ray generator; and operating keys being connected to said setting means for the unrestricted data setting thereof, said setting means being controlled by said data storage means through said operating keys responsive to depression of one of said operating keys and with said programming switch being in an inoperative condition.

3. An installation as claimed in claim 1, said storage cell means in said data storage means corresponding in number to the number of said operating keys, each of said storage cell means including a number of single storages corresponding to the number of the exposure data being stored.

4. An installation as claimed in claim 3, said setting storage including a number of storage cells corresponding to the number of exposure data connected to the single storages of the data setting means and to the operating elements for unrestricted data setting, and and storage cells being in contact with corresponding setting elements of said X-ray generator.

5. An installation as claimed in claim 1, said programming switch comprising a key switch.

* * * * *